US008342767B1

(12) United States Patent
Sylvester

(10) Patent No.: US 8,342,767 B1
(45) Date of Patent: Jan. 1, 2013

(54) TOOTHBRUSH WITH INTEGRAL TOOTHPASTE DISPENSER AND ASSOCIATED METHOD

(76) Inventor: Joy P. Sylvester, Newark, NJ (US)

( * ) Notice: Subject to any disclaimer, the term of this patent is extended or adjusted under 35 U.S.C. 154(b) by 498 days.

(21) Appl. No.: 12/589,093

(22) Filed: Oct. 16, 2009

(51) Int. Cl.
*A47L 13/22* (2006.01)

(52) U.S. Cl. ..... 401/277; 401/270; 401/172

(58) Field of Classification Search ..... 401/188 R, 401/68, 75, 171–175, 268, 270, 277
See application file for complete search history.

(56) References Cited

U.S. PATENT DOCUMENTS

| | | | | |
|---|---|---|---|---|
| 2,358,645 A | | 9/1944 | Kiff | 401/276 |
| 2,562,937 A | | 8/1951 | Moricich | 222/104 |
| 2,766,472 A | | 10/1956 | Durrett | 401/281 |
| 2,908,924 A | | 10/1959 | Turman | 401/173 |
| 3,738,761 A | | 6/1973 | Segerstad | 401/173 |
| 3,995,648 A | * | 12/1976 | Kuryla | 401/173 |
| 4,013,370 A | | 3/1977 | Gingras | 401/175 |
| 4,062,635 A | | 12/1977 | Teh-Sheng | 401/175 |
| 4,199,270 A | | 4/1980 | Tomasini | 401/183 |
| 4,277,194 A | * | 7/1981 | Smith | 401/173 |
| 4,375,924 A | | 3/1983 | Lemire | 401/173 |
| 4,744,124 A | | 5/1988 | Wang et al. | 15/105 |
| 5,259,086 A | | 11/1993 | Fong | 15/105 |
| 5,439,014 A | | 8/1995 | Moussa | 132/311 |
| 5,755,523 A | | 5/1998 | Seydel | 401/176 |
| 6,273,629 B1 | | 8/2001 | Jordan | |
| 6,334,451 B1 | | 1/2002 | Yang | |
| 6,851,882 B1 | | 2/2005 | Maloney | 401/183 |
| 6,957,925 B1 | | 10/2005 | Jacobs | |
| 7,774,888 B2 | * | 8/2010 | Chen | 15/105 |

FOREIGN PATENT DOCUMENTS

WO WO 04/028292 4/2004

OTHER PUBLICATIONS

"Twist & Paste Mashes-Up Toothbrush, toothpaste," found @ http://technabob.com/blog/2011/03/23/twist-brush-syringe-toothbrush/.

* cited by examiner

*Primary Examiner* — David Walczak
(74) *Attorney, Agent, or Firm* — Ernest D. Buff; Ernest D. Buff & Assoc. LLC

(57) ABSTRACT

A toothpaste dispensing toothbrush includes a handle, a brush head section, and a plunger assembly passed through a proximal opening of the handle and rotatably interfitted within a threaded axial bore. A body of toothpaste is attached to the plunger assembly wherein a leading portion of the toothpaste body is linearly ingressed into the brush head section when the plunger assembly is rotated along a first arcuate direction defined about a centrally oriented longitudinal axis of the threaded axial bore. In this manner, a trailing portion of the toothpaste body is retracted from the outlet and returned upstream along the brush head section when the plunger assembly is rotated along a second arcuate direction defined about the centrally oriented longitudinal axis. The first arcuate direction is opposite to the first arcuate direction so that the plunger assembly can be rotated in clockwise and counter directions respectively.

19 Claims, 9 Drawing Sheets

TOOTHBRUSH WITH INTEGRAL TOOTHPASTE DISPENSER AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to toothbrushes and, more particularly, to a toothbrush with an integral toothpaste dispenser for prohibiting toothpaste residue from drying at a bristle head of the toothbrush.

2. Prior Art

In this highly industrialized society, we often have a chance to stay away from home for business or types of traveling, thus requiring a toiletry set that typically contains at least a toothbrush, toothpaste, a towel, and soap. However, sometimes, one or two items in the toiletry set may be forgotten during packing preparations and, for example, the toothbrush may have been packed but the toothpaste has been carelessly forgotten. Hence, the teeth are brushed roughly or tumbled with water instead. As a result, the personal hygiene and the body health are affected unconsciously. Furthermore, foul breath may result in unintentional rude manners to others as one attempts to avoid conversations and the like.

The simply packed hygienic toothbrush in the hotel usually provides poor quality since the bristles on the toothbrush may sting the mouth or fall off during brushing. Even if the toothbrush provided by the hotel is expensively made with better quality, it is wasteful because usually the toothbrush in the hotel is discarded after being used once. If the toothbrush is going to be used for a second or third time, the toothpaste offered by the hotel is spent by this time. Besides, our contemporaries pay more attention to hygiene than before, and a lot of people are used to brushing teeth more than once a day such that a toothbrush and toothpaste is required after taking a lunch break. It is quite inconvenient, however, to carry a toothbrush and toothpaste dispenser every morning while we leaving out for work.

Accordingly, a need remains for a toothbrush with an integral toothpaste dispenser in order to overcome the above-noted shortcomings. The present invention satisfies such a need by providing an assembly that is convenient and easy to use, is durable yet lightweight in design, is versatile in its applications, and provides users with a toothpaste dispensing toothbrush for prohibiting toothpaste residue from drying at a bristle head of the toothbrush.

BRIEF SUMMARY OF THE INVENTION

In view of the foregoing background, it is therefore an object of the present invention to provide a toothpaste dispensing toothbrush for preventing toothpaste residue from clogging the toothpaste dispensing toothpaste dispensing toothbrush. These and other objects, features, and advantages of the invention are provided by a toothpaste dispensing toothbrush including a handle having axially opposed distal and proximal openings. Such a handle may further have a threaded axial bore formed therein and may be in fluid communication with the proximal and distal openings. A brush head section may be removably attached to the distal opening of the handle. Such a brush head section preferably has an outlet formed at a distal end thereof.

The toothpaste dispensing toothbrush further includes a plunger assembly passed through the proximal opening of the handle and rotatably interfitted within the threaded axial bore. Such a plunger assembly advantageously remains spaced upstream of the brush head section. A body of toothpaste is attached to the plunger assembly wherein a leading portion of the toothpaste body is linearly ingressed into the brush head section when the plunger assembly is rotated along a first arcuate direction defined about a centrally oriented longitudinal axis of the threaded axial bore. In this manner, a trailing portion of the toothpaste body is retracted from the outlet and returned upstream along the brush head section when the plunger assembly is rotated along a second arcuate direction defined about the centrally oriented longitudinal axis. The first arcuate direction is opposite to the first arcuate direction so that the plunger assembly can be rotated in clockwise and counter directions respectively.

In one embodiment, the brush head section preferably includes a cavity in fluid communication with the threaded axial bore such that the toothpaste body is urged directly into the cavity when expelled from the distal opening of the handle. A suction valve is intermediately situated between the outlet and the distal opening of the brush head section. Such a suction valve may be urged to an open position when the leading portion of the toothpaste body is linearly displaced downstream and upstream of the brush head section. Such a suction valve automatically returns to a closed position after the leading portion of the toothpaste body is displaced downstream and upstream of the suction valve such that the leading portion of the toothpaste body is retracted upstream of the suction valve and thereby remains isolated from ambient air during non-operating conditions.

In one embodiment, the brush head section is formed from deformably resilient material so that the suction valve is manually toggled between the open and closed positions when the cavity is manually squeezed and released respectively. Such a leading portion of the toothpaste body may be displaced downstream and upstream of the suction valve when the cavity is squeezed and released respectively such that the toothpaste residue is ejected from the outlet thereby prohibited from may be lodge at the outlet during non-operating conditions.

In one embodiment, the plunger assembly preferably includes an actuating dial situated exterior of the handle and rotatably abutted against the end cap. A rectilinear tube is statically affixed to the actuating dial and may be situated inside the threaded axial bore. Such a tube may be provided with diametrically opposed first and second linear slots formed along a longitudinal length thereof. A receiving cup may be seated inside the tube and may be removably mated thereto. Such a receiving cup may be rotatably displaced along the first and second slots as the tube is rotated along the first and second arcuate directions respectively. Also, the receiving cup may be mated with a proximal end of the toothpaste body while seated inside the tube.

In one embodiment, the toothpaste body and the receiving cup are synchronously and rotatably reciprocated along a longitudinal length of the tube as the actuating dial and the tube are simultaneously rotated along the first and second arcuate directions. Such a tube remains within the threaded axial bore and the handle as the receiving cup and the toothpaste body are reciprocated within the tube.

In one embodiment, the receiving cup is provided with first and second diametrically opposed knobs radially protruding outwardly away from a perimeter wall of the receiving cup. Such first and second knobs may be passing through the first and second slots and may be interfitted with a threaded inner wall of the threaded axial bore. Such a receiving cup may be rotatably displaced along the slots while maintaining direct contact with the threaded inner wall of the threaded axial bore.

In one embodiment, the end cap remains statically mated to the proximal end of the handle while the actuating dial and the tube are rotated about the central longitudinal axis.

In one embodiment, a user interface is provided. An internal power source electrically coupled to the user interface and an audio playback device electrically coupled to the user interface and the power source. A speaker is electrically coupled to the audio playback device. Notably, the audio playback device causes the speaker to emit an audible signal upon receiving an instruction signal from the user interface.

The present invention may further include a method of utilizing a toothpaste dispensing toothbrush for preventing toothpaste residue from clogging the toothpaste dispensing toothpaste dispensing toothbrush. Such a method preferably includes the chronological steps of: providing a handle having axially opposed distal and proximal openings wherein the handle has a threaded axial bore formed therein and may be in fluid communication with the proximal and distal openings; providing and removably attaching a brush head section to the distal opening of the handle wherein the brush head section has an outlet formed at a distal end thereof; providing and passing a plunger assembly through the proximal opening of the handle by rotatably interfitting the plunger assembly within the threaded axial bore; providing and attaching a body of toothpaste to the plunger assembly; and maintaining the plunger assembly spaced upstream of the brush head section.

The method further includes the steps of: linearly ingressing a leading portion of the toothpaste body into the brush head section by rotating the plunger assembly along a first arcuate direction defined about a centrally oriented longitudinal axis of the threaded axial bore; and retracting a trailing portion of the toothpaste body from the outlet and thereby returning the trailing portion upstream along the brush head section by rotating the plunger assembly along a second arcuate direction defined about the centrally oriented longitudinal axis.

Being easy to use, individuals appreciate the effortless squeeze of fresh toothpaste expelled onto the bristles of the assembly via the handy dispensing button. When used in the home, the practical toothbrush/toothpaste combination frees much needed counter space from bulky and messy tubes of toothpaste. In addition, the plastic casing protects the assembly from surface areas and from the harmful bacteria and germs swirling through the air. For travelers, the present invention is especially convenient. Since it is easily packed into any shaving kit, traveling bag, or carry-on, the assembly eliminates the need for cumbersome toothpaste tubes that can leak onto belongings. Additionally, hotel guests can enjoy the convenience of the present invention. If made available in hotel vending machines, gift shops, and at lobby desks, the assembly can provide a quick and sanitary solution for those who have left their toothbrush at home.

Since it is compact and lightweight, the present invention allows users to have access to proper oral hygiene at all times, as it is easily carried in a coat or pants pocket, a purse, or a backpack. Being easy to use, individuals appreciate the effortless squeeze of fresh toothpaste expelled onto the bristles of the assembly via the handy dispensing button. When used in the home, the practical toothbrush/toothpaste combination frees much needed counter space from bulky and messy tubes of toothpaste.

In addition, the plastic casing protects the assembly from surface areas and from the harmful bacteria and germs swirling through the air. For travelers, the present invention is especially convenient. Since it is easily packed into any shaving kit, traveling bag, or carry-on, the assembly eliminates the need for cumbersome toothpaste tubes that can leak onto belongings.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
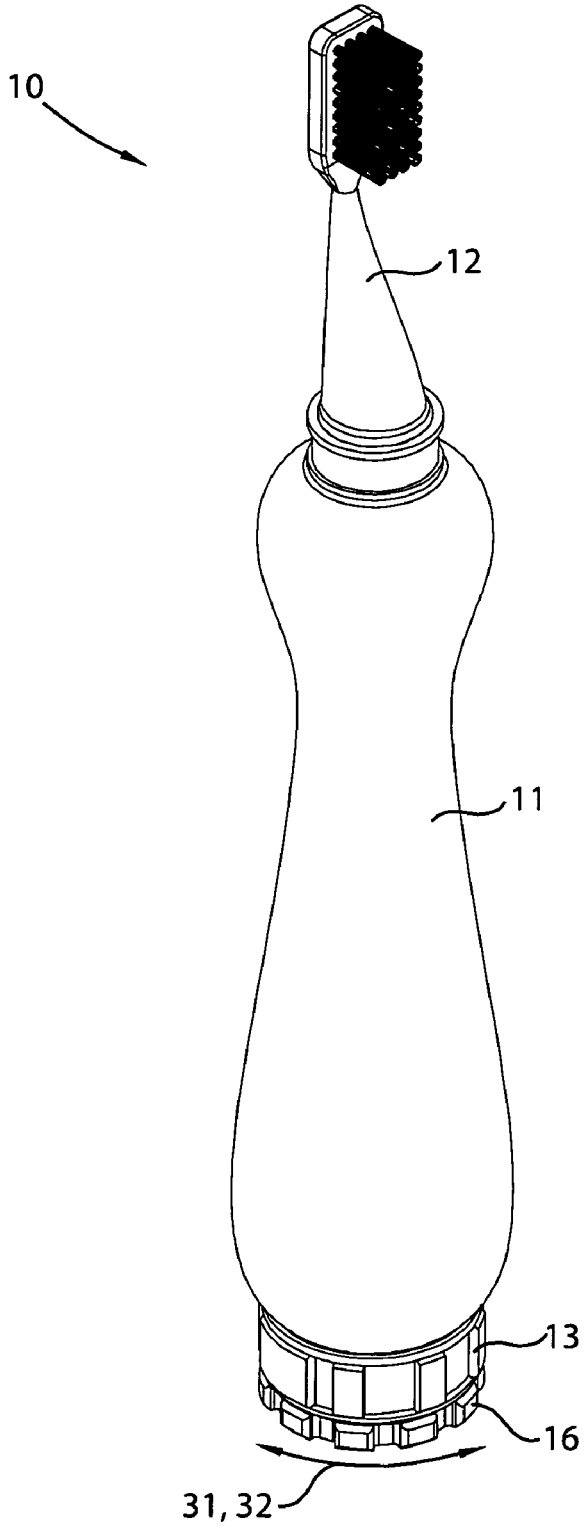
FIG. 1 is a perspective view showing a toothpaste dispensing toothbrush, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-11 by the reference numeral 10 and is intended to provide a toothpaste dispensing toothbrush for preventing toothpaste residue from clogging the toothpaste dispensing toothpaste dispensing toothbrush. It should be understood that the toothpaste dispensing toothbrush 10 may be used to dispense many different types of toothpastes and should not be construed as being limited to any one particular type of toothpaste.

Referring to FIGS. 1-11, a toothpaste dispensing toothbrush 10 including a handle 11 having axially opposed distal 25 and proximal 24 openings. Such a handle 11 may further have a threaded axial bore 23 formed therein and may be in fluid communication with the proximal 24 and distal openings 25. A brush head section 12 may be removably attached to the distal opening 25 of the handle 11. Such a brush head section 12 preferably has an outlet 26 formed at a distal end 38 thereof.

Figure 2:
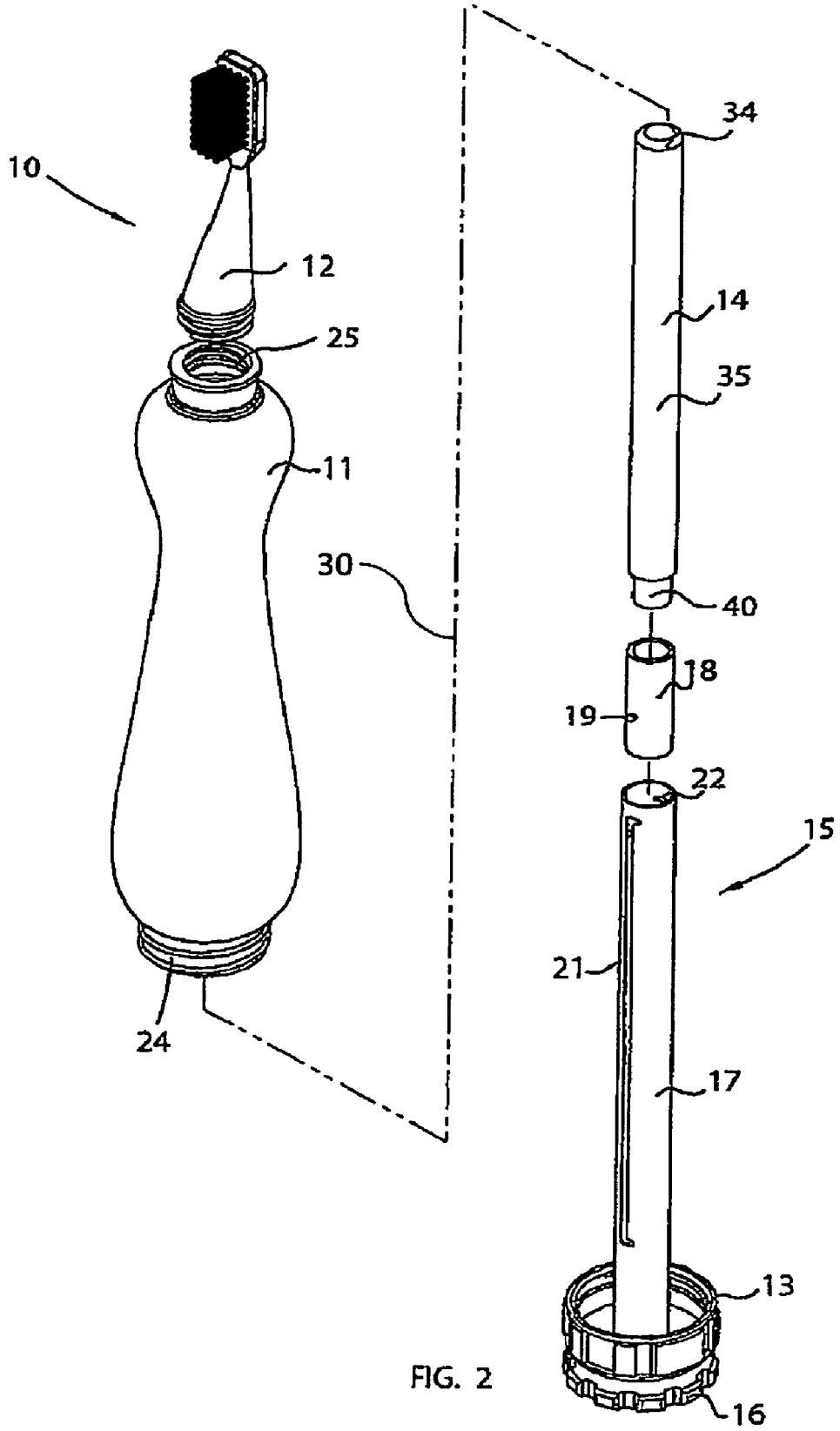
FIG. 2 is an exploded view of the toothbrush shown in FIG. 1.
Figure 4:
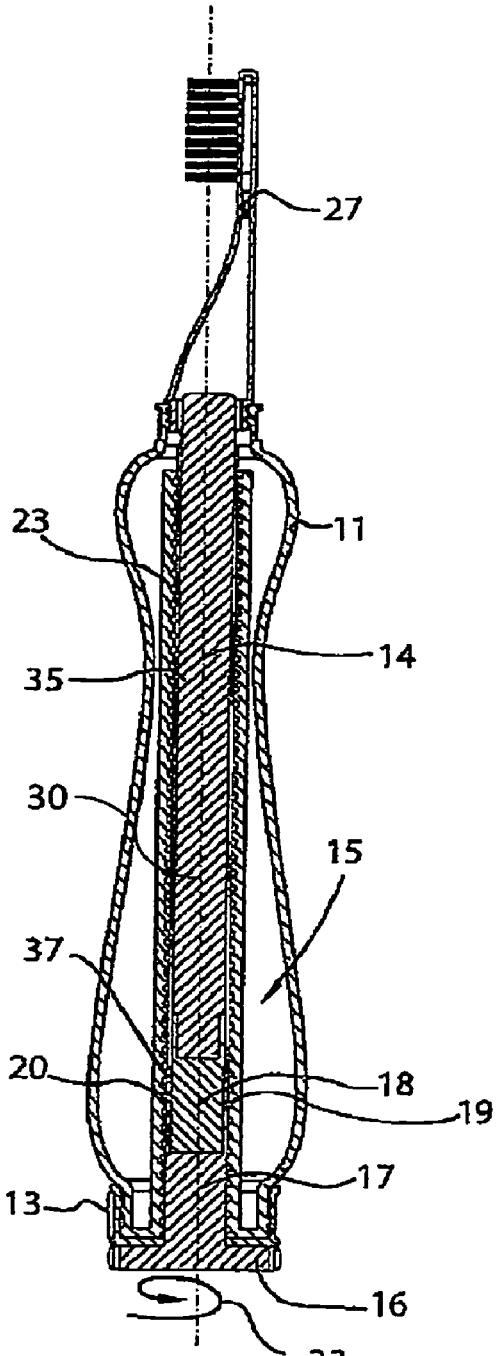
FIG. 4 is a cross-sectional view taken along line 4-4 in FIG. 3.
Figure 5:
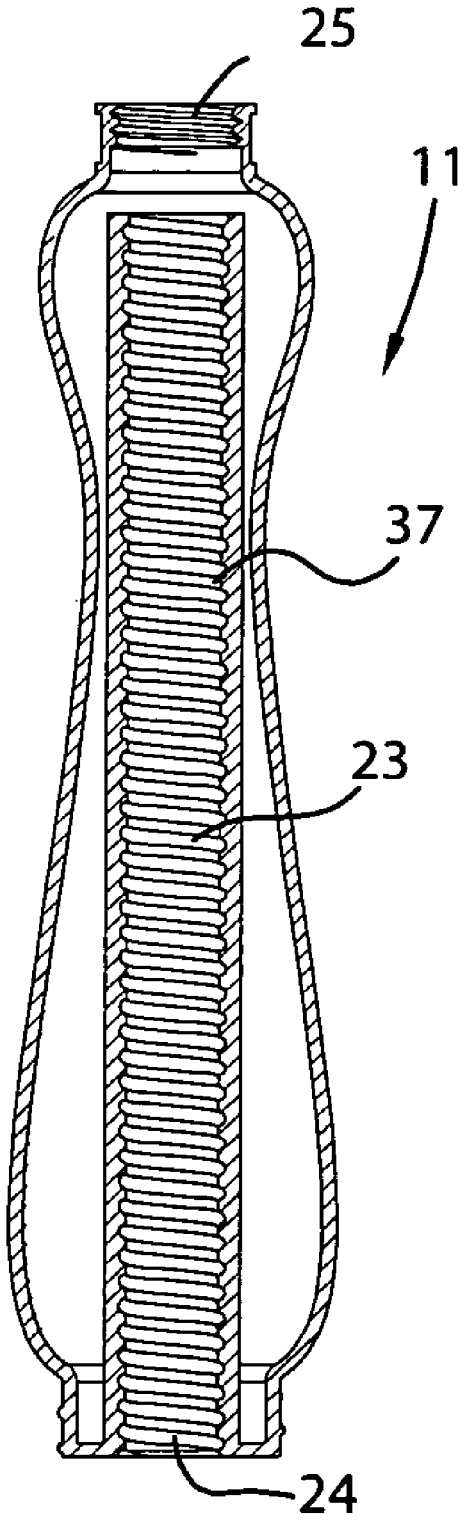
FIG. 5 is a cross-sectional view of the handle showing the threaded axial bore situated therein.
Figure 6:
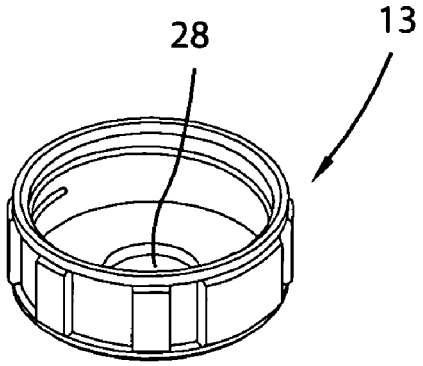
FIG. 6 is a perspective view of the end cap.

Referring to FIGS. 2 and 4 in particular, the toothpaste dispensing toothbrush 10 further includes a plunger assembly 15 passed through the proximal opening 24 of the handle 11 and rotatably interfitted within the threaded axial bore 23. Such a plunger assembly 15 advantageously remains spaced upstream of the brush head section 12. A body of toothpaste 14 is attached to the plunger assembly 15 wherein a leading portion 34 of the toothpaste body 14 is linearly ingressed into the brush head section 12 when the plunger assembly 15 is rotated along a first arcuate direction 32 defined about a centrally oriented longitudinal axis 30 of the threaded axial bore 23. In this manner, a trailing portion 35 of the toothpaste body 14 is retracted from the outlet 26 and returned upstream along the brush head section 12 when the plunger assembly 15 is rotated along a second arcuate direction 31 defined about the centrally oriented longitudinal axis 30. The first arcuate direction 32 is opposite to the second arcuate direction 31 so that the plunger assembly 15 can be rotated in clockwise and counter directions respectively.

Figure 10:
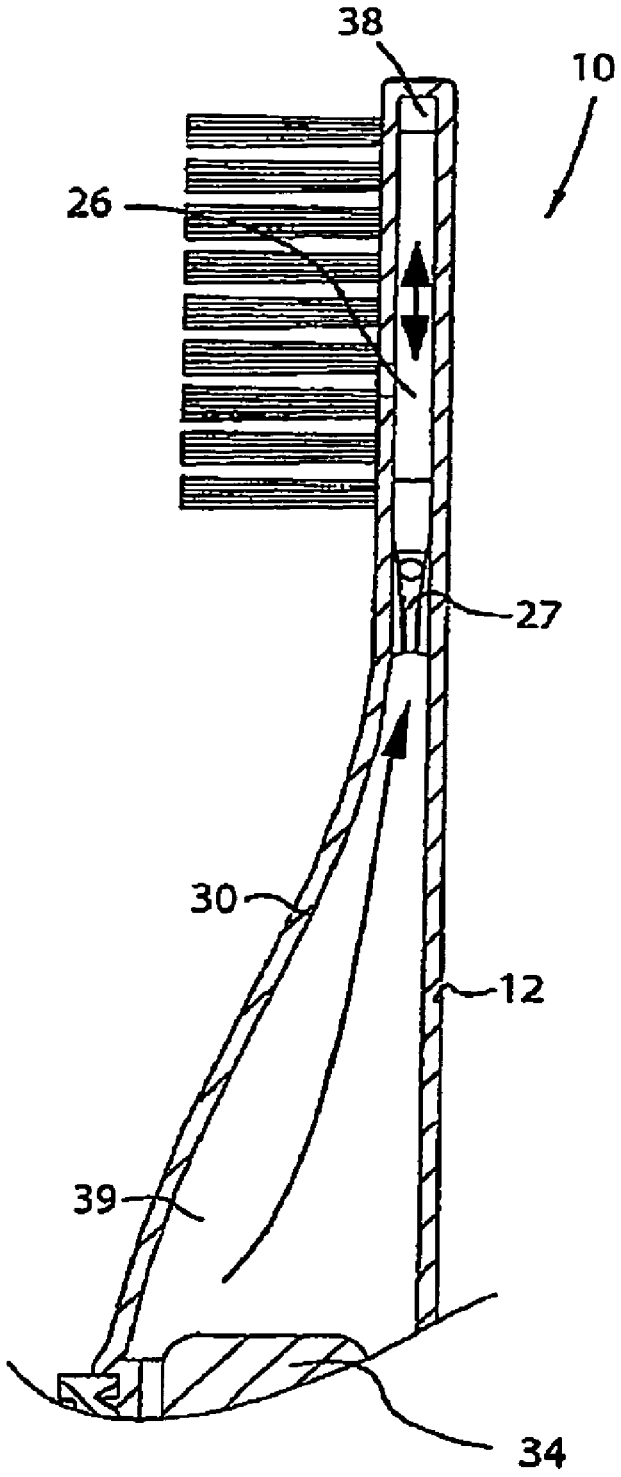
FIGS. 10 and 10*a* are enlarged sectional views of the suction valve toggled between the open and closed positions as the cavity is squeezed and released.
Figure 10A:
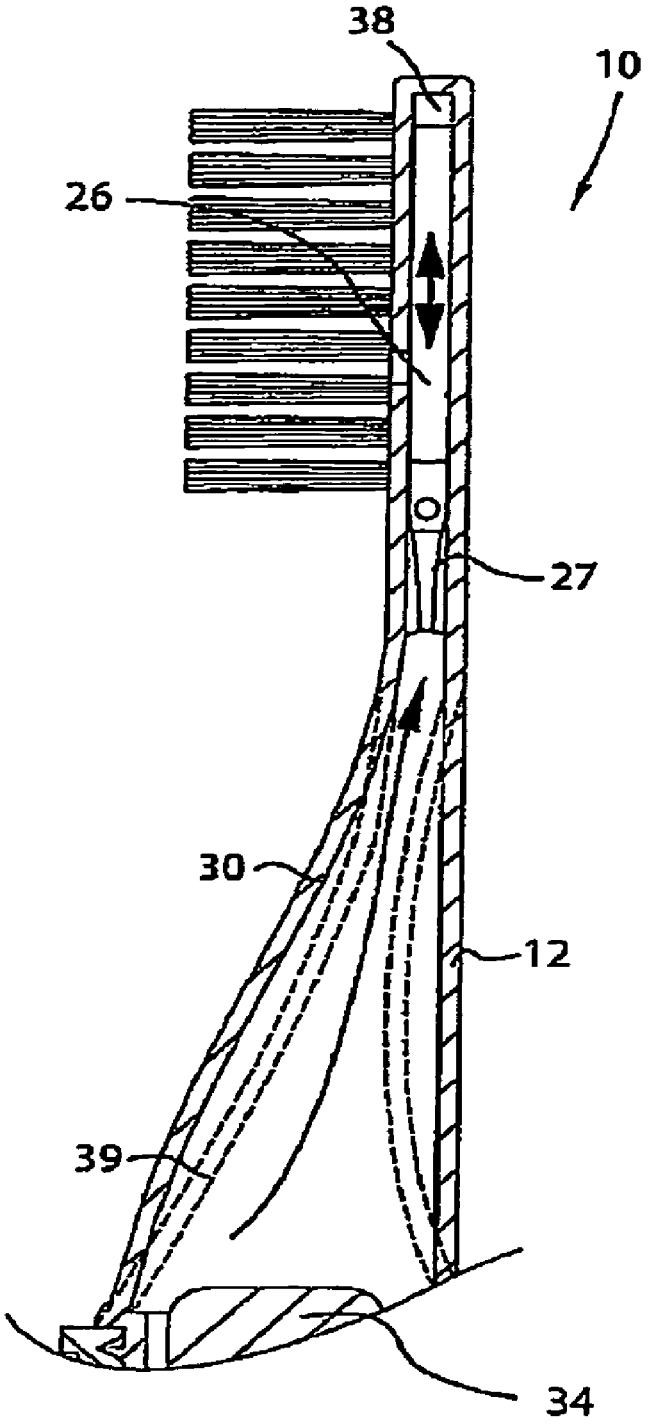

As perhaps best shown in FIGS. 4 and 10, the brush head section 12 preferably includes a cavity 39 in fluid communication with the threaded axial bore 23 such that the toothpaste body 14 is urged directly into the cavity 39 when expelled from the distal opening 25 of the handle 11. A suction valve 27 is intermediately situated between the outlet 26 and the distal opening 25 of the handle 11. Such a suction valve 27 may be urged to an open position when the leading portion 34 of the toothpaste body 14 is linearly displaced downstream and upstream of the brush head section 12. Such a suction valve 27 automatically returns to a closed position after the leading portion 34 of the toothpaste body 14 is displaced downstream and upstream of the suction valve 27 such that the leading portion 34 of the toothpaste body 14 is retracted upstream of the suction valve 27 and thereby remains isolated from ambient air during non-operating conditions.

Still referring to FIGS. 4 and 10, the brush head section 12 is formed from deformably resilient material so that the suction valve 27 is manually toggled between the open and closed positions when the cavity 39 is manually squeezed and released respectively. Such a leading portion 34 of the toothpaste body 14 may be displaced downstream and upstream of the suction valve 27 when the cavity 39 is squeezed and released respectively such that toothpaste residue is ejected from the outlet 26 and thereby prohibited from being lodged at the outlet 26 during non-operating conditions, as perhaps best shown in FIG. 10.

Figure 7:
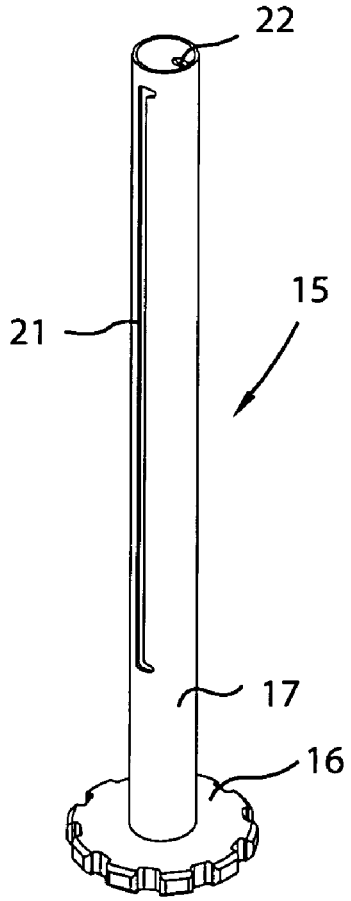
FIG. 7 is a perspective view of the rotary dial statically coupled to the slotted tube.
Figure 8:
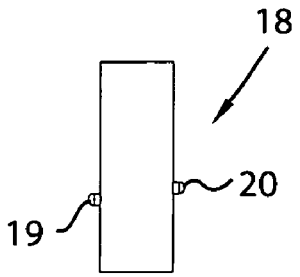
FIG. 8 is a side elevational view of the receiving cup.
Figure 9:
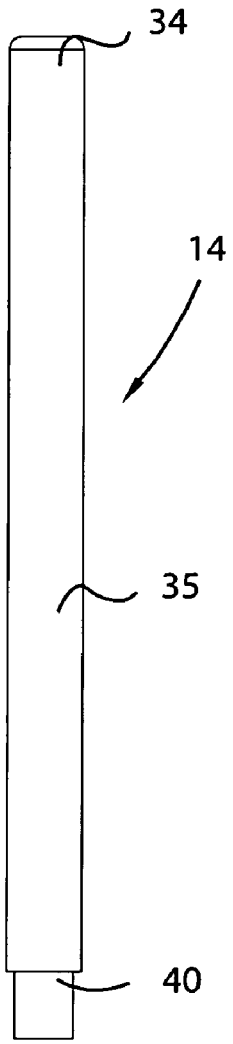
FIG. 9 is a side elevational view of the toothpaste body.

Referring to FIGS. 2, 4 and 7, the plunger assembly 15 preferably includes an actuating dial 16 situated exterior of the handle 11 and rotatably abutted against the end cap 13. A rectilinear tube 17 is statically affixed to the actuating dial 16 and may be situated inside the threaded axial bore 23. Such a tube 17 may be provided with diametrically opposed first and second linear slots 21, 22 formed along a longitudinal length thereof. A receiving cup 18 may be seated inside the tube 17 and may be removably mated thereto. Such a receiving cup 18 may be rotatably displaced along the first and second slots 21, 22 as the tube 17 is rotated along the first and second arcuate directions 31, 32, respectively. Also, the receiving cup 18 may be mated with a proximal end 40 of the toothpaste body 14 while seated inside the tube 17.

Referring to FIGS. 2 and 4, the toothpaste body 14 and the receiving cup 18 are synchronously and rotatably reciprocated along a longitudinal length of the tube 17 as the actuating dial 16 and the tube 17 are simultaneously rotated along the first and second arcuate directions 31, 32. Such a tube 17 remains within the threaded axial bore 23 and the handle 11 as the receiving cup 18 and the toothpaste body 14 are reciprocated within the tube 17.

Referring to FIGS. 2, 4, 5 and 8, the receiving cup 18 is provided with first and second diametrically opposed knobs 19, 20 radially protruding outwardly away from a perimeter wall of the receiving cup 18. Such first and second knobs 19, 20 may pass through the first and second slots 21, 22 and may be interfitted with a threaded inner wall 37 of the threaded axial bore 23. Such a receiving cup 18 may be rotatably displaced along the slots 21, 22 while maintaining direct contact with the threaded inner wall 37 of the threaded axial bore 23.

Figure 3:
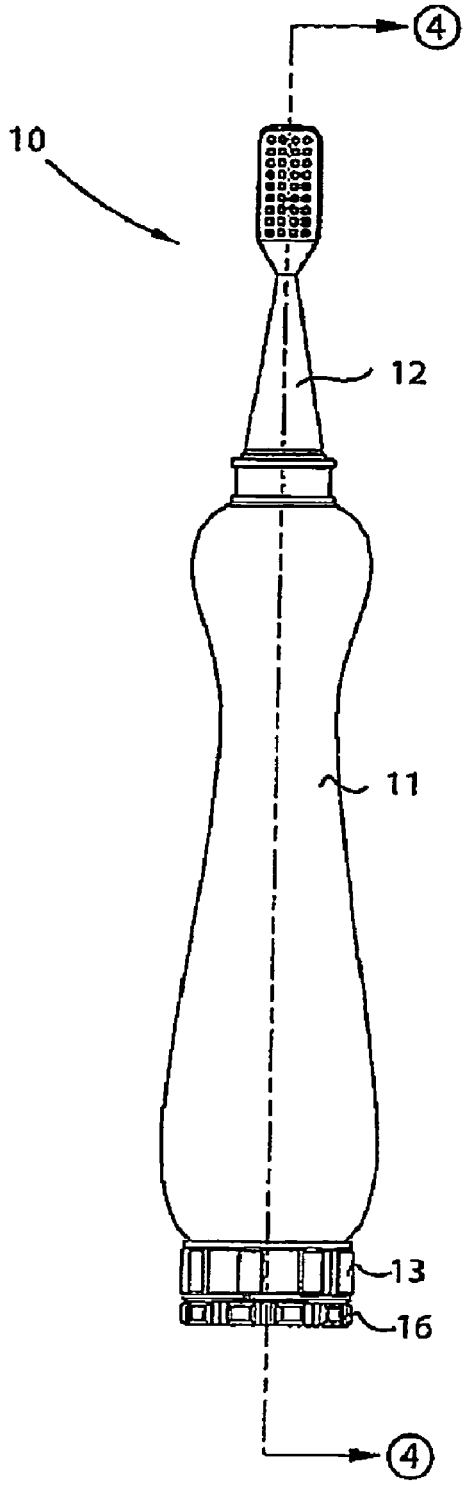
FIG. 3 is a front elevational view of the toothbrush shown in FIG. 1.

As perhaps best shown in FIGS. 3 and 4, the end cap 13 remains statically mated to the proximal end of the handle 11 while the actuating dial 16 and the tube 17 are rotated about the central longitudinal axis 30.

Figure 11:
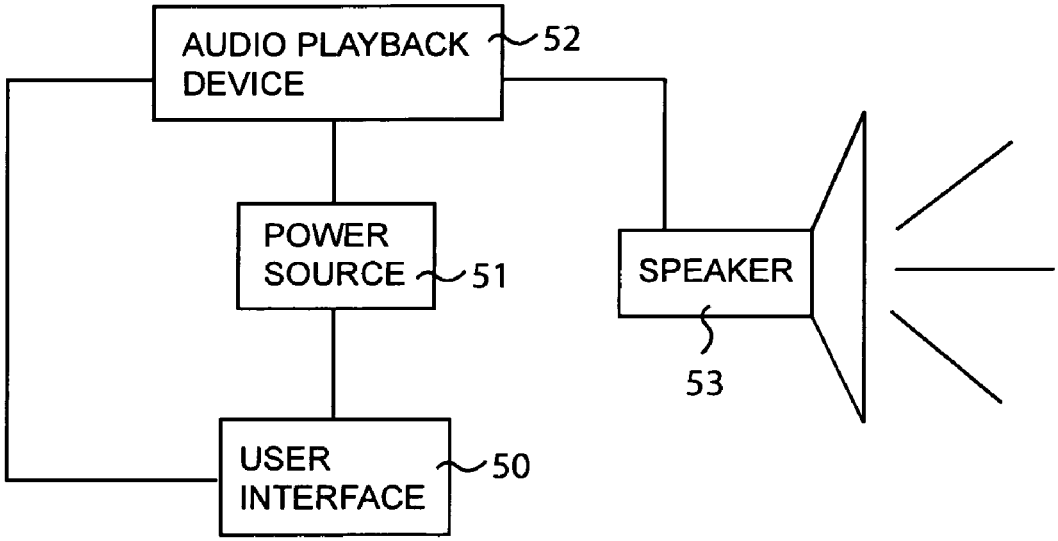
FIG. 11 is a high-level schematic block diagram showing the interrelationship between the major electronic components of present invention.

Referring to FIG. 11, one embodiment of the present invention includes a user interface 50, an internal power source 51 electrically coupled to the user interface 50. An audio playback device 52 is electrically coupled to the user interface 50 and the power source 51. A speaker 53 is electrically coupled to the audio playback device 52. Notably, the audio playback device 52 causes the speaker 53 to emit an audible signal upon receiving an instruction signal from the user interface 50.

The present invention may further include a method of utilizing a toothpaste dispensing toothbrush 10 for preventing toothpaste residue from clogging the toothpaste dispensing toothbrush 10. Such a method preferably includes the chronological steps of: providing a handle 11 having axially opposed distal 25 and proximal 24 openings wherein the handle 11 has a threaded axial bore 23 formed therein and may be in fluid communication with the proximal 24 and distal openings 25; providing and removably attaching a brush head section 12 to the distal opening 25 of the handle 11 wherein the brush head section 12 has an outlet 26 formed at a distal end 38 thereof; providing and passing a plunger assembly 15 through the proximal opening 24 of the handle 11 by rotatably interfitting the plunger assembly 15 within the threaded axial bore 23; providing and attaching a body of toothpaste 14 to the plunger assembly 15; and maintaining the plunger assembly 15 spaced upstream of the brush head section 12.

The method further includes the steps of: linearly ingressing a leading portion 34 of the toothpaste body 14 into the brush head section 12 by rotating the plunger assembly 15 along a first arcuate direction 32 defined about a centrally oriented longitudinal axis 30 of the threaded axial bore 23; and retracting a trailing portion 35 of the toothpaste body 14 from the outlet 26 and thereby returning the trailing portion 35 upstream along the brush head section 12 by rotating the plunger assembly 15 along a second arcuate direction 31 defined about the centrally oriented longitudinal axis 30.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A toothpaste dispensing toothbrush for preventing toothpaste residue from clogging said toothpaste dispensing toothpaste dispensing toothbrush, said toothpaste dispensing toothbrush comprising:

a handle having opposed distal and proximal openings, said handle further having a threaded axial bore formed therein and being in fluid communication with said proximal and distal openings;

a brush head section removably attached to said distal opening of said handle, said brush head section having an outlet formed at a distal end thereof;

a plunger assembly passed through said proximal opening of said handle rotatably interfitted within said threaded axial bore; and a body of toothpaste attached to said plunger assembly;

wherein a leading portion of said toothpaste body is linearly ingressed into said brush head section when said plunger assembly is rotated along a first arcuate direction defined about a centrally oriented longitudinal axis of said threaded axial bore;

wherein a trailing portion of said toothpaste body is retracted from said outlet and returned upstream along said brush head section when said plunger assembly is rotated along a second arcuate direction defined about said centrally oriented longitudinal axis.

2. The toothpaste dispensing toothbrush of claim 1, wherein said first arcuate direction is opposite to said first arcuate direction.

3. The toothpaste dispensing toothbrush of claim 1, wherein said brush head section comprises:

a cavity in fluid communication with said threaded axial bore such that said toothpaste body is urged directly into said cavity when expelled from said distal opening of said handle; and a suction valve intermediately situated between said outlet and said distal opening of said handle, said suction valve being urged to an open position when said leading portion of said toothpaste body is linearly displaced downstream and upstream of said brush head section, said suction valve automatically returning to a closed position after said leading portion of said toothpaste body is displaced downstream and upstream of said suction valve such that said leading portion of said toothpaste body is retracted upstream of said suction valve and thereby remains isolated from ambient air during non-operating conditions.

4. The toothpaste dispensing toothbrush of claim 3, wherein said brush head section is formed from deformably resilient material so that said suction valve is manually toggled between said open and closed positions when said cavity is manually squeezed and released respectively, said leading portion of said toothpaste body being displaced downstream and upstream of said suction valve when said cavity is squeezed and released respectively such that the toothpaste residue is ejected from said outlet thereby prohibited from being lodge at said outlet during non-operating conditions.

5. The toothpaste dispensing toothbrush of claim 4, wherein said plunger assembly comprises:

an actuating dial situated exterior of said handle and rotatably abutted against an end cap;

a rectilinear tube statically affixed to said actuating dial and being situated inside said threaded axial bore, said tube being provided with diametrically opposed first and second linear slots formed along a longitudinal length thereof; and a receiving cup seated inside said tube and being removably mated thereto, said receiving cup being rotatably displaced along said first and second slots as said tube is rotated along said first and second arcuate directions respectively, said receiving cup being mated with a proximal end of said toothpaste body while seated inside said tube.

6. The toothpaste dispensing toothbrush of claim 5, wherein said toothpaste body and said receiving cup are synchronously and rotatably reciprocated along a longitudinal length of said tube as said actuating dial and said tube are simultaneously rotated along said first and second arcuate directions, said tube remaining within said threaded axial bore and said handle as said receiving cup and said toothpaste body are reciprocated within said tube.

7. The toothpaste dispensing toothbrush of claim 6, wherein said receiving cup is provided with first and second diametrically opposed knobs radially protruding outwardly away from a perimeter wall of said receiving cup, said first and second knobs being passing through said first and second slots and being interfitted with a threaded inner wall of said threaded axial bore, said receiving cup being rotatably displaced along said slots while maintaining direct contact with said threaded inner wall of said threaded axial bore.

8. The toothpaste dispensing toothbrush of claim 5, wherein said end cap remains statically mated to said proximal end of said handle while said actuating dial and said tube are rotated about said central longitudinal axis.

9. The toothpaste dispensing toothbrush of claim 1, further comprising: a user interface;

an internal power source electrically coupled to said user interface;

an audio playback device electrically coupled to said user interface and said power source; and a speaker electrically coupled to said audio playback device;

wherein said audio playback device causes said speaker to emit an audible signal upon receiving an instruction signal from said use interface.

10. A toothpaste dispensing toothbrush for preventing toothpaste residue from clogging said toothpaste dispensing toothpaste dispensing toothbrush, said toothpaste dispensing toothbrush comprising:

a handle having axially opposed distal and proximal openings, said handle further having a threaded axial bore formed therein and being in fluid communication with said proximal and distal openings;

a brush head section removably attached to said distal opening of said handle, said brush head section having an outlet funned at a distal end thereof;

a plunger assembly passed through said proximal opening of said handle and rotatably interfitted within said threaded axial bore, said plunger assembly remaining spaced upstream of said brush head section; and a body of toothpaste attached to said plunger assembly, wherein a leading portion of said toothpaste body is linearly ingressed into said brush head section when said plunger assembly is rotated along a first arcuate direction defined about a centrally oriented longitudinal axis of said threaded axial bore;

wherein a trailing portion of said toothpaste body is retracted from said outlet and returned upstream along said brush head section when said plunger assembly is rotated along a second arcuate direction defined about said centrally oriented longitudinal axis.

11. The toothpaste dispensing toothbrush of claim 10, wherein said first arcuate direction is opposite to said first arcuate direction.

12. The toothpaste dispensing toothbrush of claim 10, wherein said brush head section comprises:

a cavity in fluid communication with said threaded axial bore such that said toothpaste body is urged directly into said cavity when expelled from said distal opening of said handle; and a suction valve intermediately situated between said outlet and said distal opening of said handle, said suction valve being urged to an open position when said leading portion of said toothpaste body is linearly displaced downstream and upstream of said brush head section, said suction valve automatically returning to a closed position after said leading portion of said toothpaste body is displaced downstream and upstream of said suction valve such that said leading portion of said toothpaste body is retracted upstream of said suction valve and thereby remains isolated from ambient air during non-operating conditions.

13. The toothpaste dispensing toothbrush of claim 12, wherein said brush head section is formed from deformably resilient material so that said suction valve is manually toggled between said open and closed positions when said cavity is manually squeezed and released respectively, said leading portion of said toothpaste body being displaced downstream and upstream of said suction valve when said cavity is squeezed and released respectively such that the toothpaste residue is ejected from said outlet thereby prohibited from being lodge at said outlet during non-operating conditions.

14. The toothpaste dispensing toothbrush of claim 13, wherein said plunger assembly comprises:

an actuating dial situated exterior of said handle and rotatably abutted against an end cap;

a rectilinear tube statically affixed to said actuating dial and being situated inside said threaded axial bore, said tube being provided with diametrically opposed first and second linear slots formed along a longitudinal length thereof; and a receiving cup seated inside said tube and being removably mated thereto, said receiving cup being rotatably displaced along said first and second slots as said tube is rotated along said first and second arcuate directions respectively, said receiving cup being mated with a proximal end of said toothpaste body while seated inside said tube.

15. The toothpaste dispensing toothbrush of claim 14, wherein said toothpaste body and said receiving cup are synchronously and rotatably reciprocated along a longitudinal length of said tube as said actuating dial and said tube are simultaneously rotated along said first and second arcuate directions, said tube remaining within said threaded axial bore and said handle as said receiving cup and said toothpaste body are reciprocated within said tube.

16. The toothpaste dispensing toothbrush of claim 15, wherein said receiving cup is provided with first and second diametrically opposed knobs radially protruding outwardly away from a perimeter wall of said receiving cup, said first and second knobs being passing through said first and second slots and being interfitted with a threaded inner wall of said threaded axial bore, said receiving cup being rotatably displaced along said slots while maintaining direct contact with said threaded inner wall of said threaded axial bore.

17. The toothpaste dispensing toothbrush of claim 14, wherein said end cap remains statically mated to said proximal end of said handle while said actuating dial and said tube are rotated about said central longitudinal axis.

18. The toothpaste dispensing toothbrush of claim 10, further comprising:

a user interface;

an internal power source electrically coupled to said user interface;

an audio playback device electrically coupled to said user interface and said power source; and a speaker electrically coupled to said audio playback device;

wherein said audio playback device causes said speaker to emit an audible signal upon receiving an instruction signal from said user interface.

19. A method of utilizing a toothpaste dispensing toothbrush for preventing toothpaste residue from clogging said toothpaste dispensing toothpaste dispensing toothbrush, said method comprising the chronological steps of providing a handle having axially opposed distal and proximal openings, said handle further having a threaded axial bore formed therein and being in fluid communication with said proximal and distal openings;

providing and removably attaching a brush head section to said distal opening of said handle, said brush head section having an outlet formed at a distal end thereof;

providing and passing a plunger assembly through said proximal opening of said handle by rotatably interfitting said plunger assembly within said threaded axial bore;

providing and attaching a body of toothpaste to said plunger assembly;

maintaining said plunger assembly spaced upstream of said brush head section;

linearly ingressing a leading portion of said toothpaste body into said brush head section by rotating said plunger assembly along a first arcuate direction defined about a centrally oriented longitudinal axis of said threaded axial bore;

retracting a trailing portion of said toothpaste body from said outlet and thereby returning said trailing portion upstream along said brush head section by rotating said plunger assembly along a second arcuate direction defined about said centrally oriented longitudinal axis.

* * * * *